United States Patent [19]

Rymal

[11] Patent Number: 4,932,837

[45] Date of Patent: Jun. 12, 1990

[54] CENTRIFUGAL PUMP FOR LIQUIDS

[76] Inventor: Ted R. Rymal, 1907 N. Frazier, Conroe, Tex. 77301

[21] Appl. No.: 260,828

[22] Filed: Oct. 21, 1988

[51] Int. Cl.[5] ..... F04D 29/22

[52] U.S. Cl. ..... 415/206; 415/169.1

[58] Field of Search ..... 415/228, 216.1, 203, 415/206, 128, 196, 218.1, 169.1; 416/188

[56] References Cited

U.S. PATENT DOCUMENTS

| | | | |
|---|---|---|---|
| 745,857 | 12/1903 | Johnson et al. | 415/206 |
| 778,590 | 12/1904 | Lager | 415/128 |
| 2,233,825 | 3/1941 | Walsh et al. | 415/218.1 |
| 2,348,246 | 5/1944 | Dixon | 415/206 |
| 2,581,055 | 1/1952 | Wahle | 415/206 |
| 2,634,685 | 4/1953 | Buchi | 415/196 |
| 2,890,660 | 6/1959 | Umbricht | 415/206 |
| 2,958,293 | 11/1960 | Pray, Jr. | 415/206 |
| 3,044,408 | 7/1962 | Mellott | 415/228 |
| 3,095,821 | 7/1963 | Elenbaas | 415/206 |
| 3,130,678 | 4/1964 | Chenault | 415/206 |
| 3,190,226 | 6/1965 | Judd | 416/188 |
| 3,272,129 | 9/1966 | Leopold | 416/183 |
| 3,280,748 | 10/1966 | Ogles | 416/188 |
| 3,295,456 | 1/1967 | Warren | 415/206 |
| 3,491,696 | 1/1970 | Howard | 415/143 |
| 3,744,635 | 7/1973 | Horvath | 415/218.1 |
| 4,053,262 | 10/1977 | Horvath | 415/218.1 |
| 4,419,048 | 12/1983 | Pilachowski et al. | 415/206 |
| 4,575,308 | 3/1986 | Corkill | 415/206 |
| 4,594,052 | 6/1986 | Niskanen | 415/121 B |
| 4,666,373 | 5/1987 | Sugiura | 416/185 |
| 4,688,991 | 8/1987 | Howard | 415/170 R |

FOREIGN PATENT DOCUMENTS

| | | | |
|---|---|---|---|
| 1528896 | 7/1969 | Fed. Rep. of Germany | 415/213 A |

*Primary Examiner*—Carl D. Price
*Assistant Examiner*—John T. Kwon
*Attorney, Agent, or Firm*—Browning, Bushman, Anderson & Brookhart

[57] ABSTRACT

A centrifugal pump is provided for transporting pressurized liquids containing solid particles. The pump housing defines a first cylindrical-shaped interior cavity and a second frustoconical interior cavity axially interconnecting the fluid inlet to the pump and the first interior cavity. An impeller includes a plurality of vanes each having a first portion positioned within the first cavity and having an outward axially extending edge spaced uniformly from the central axis of the pump. Each of the vanes includes a second portion positioned within the second cavity and having an outward axially extending edge spaced from the central axis a variable distance directly proportional to its axial spacing from the fluid inlet. The edge of each of the vanes is spaced a preselected distance of at least one quarter inch from the side walls of the housing, such that each of the vanes remains out of sealing engagement with the housing. The pump is not susceptible to plugging, jamming, or excessive repair caused by the solid materials in the liquid, and a relatively low horse power motor can efficiently pump fluids at a comparatively high pressure.

19 Claims, 1 Drawing Sheet

CENTRIFUGAL PUMP FOR LIQUIDS

BACKGROUND OF THE INVENTION

1. Field of the Invention

The present invention relates to pumps and, more particularly, relates to centrifugal pumps particularly well suited for reliably pumping liquids containing solid materials without damaging the pump or causing excessive pump repairs.

2. Description of the Prior Art

Centrifugal pumps have long been used and are preferred in many applications for moving liquids under pressure. U.S. Pat. No. 745,857 discloses a rotary pump having outer and inner walls which draws liquid through an axially aligned inlet, and discharges liquid from a tangential outlet. Centrifugal pumps, as disclosed in U.S. Pat. No. 2,348,246, typically include rotary vanes intended for 37 wiping" the surrounding pump walls to move fluid through the pump. Other types of centrifugal pumps are disclosed in U.S. Pat. Nos. 2,581,055, 3,095,821, and 3,272,129. A backward-inclined impeller for a centrifugal pump is disclosed in U.S. Pat. No. 4,666,373.

Special problems are understandably encountered when using a centrifugal pump to pump liquids containing a high percentage of solids. A centrifugal pump particularly designed for handling sewage which contains solid objects is disclosed in U.S. Pat. No. 3,130,678. A similar pump with improved non-clogging characteristics intended for handling sewage is disclosed in U.S. Pat. No. 3,295,456. A mixed flow "trash pump" with a resilient liner is disclosed in U.S. Pat. No. 4,419,048. This latter pump is particularly designed for handling water which contains silt, sand, or other abrasive materials. A pump with impeller vanes having a leading edge behind a flange with cutting edge grooves is disclosed in U.S. Pat. No. 4,594,052, such that the leading edge of the vane and the cutting edge grooves detach and shred fibers and sticks in the liquid. This design allegedly prevents these solid objects from accumulating, and prevents the objects from being conveyed into a slot between the vane and the housing.

In spite of these attempts, prior art centrifugal pumps still are frequently not able to reliably handle liquids containing solid objects. Pumps frequently become plugged with solids and/or the solid objects become jammed between the pump housing and the impeller. Moreover, repair costs for prior art centrifugal pumps used to handle liquids with solid objects is extremely high.

In an attempt to minimize the problems associated with prior art centrifugal pumps intended for handling fluids with solid objects, pumps have been devised wherein the impellers are functionally out of the flow path of the fluid. U.S. Pat. No. 2,958,293, for example, discloses a pump with an impeller which is substantially removed from the flow path of the fluid. The stated objective of such a pump is to minimize or reduce jamming or clogging of the pump in response to solid particles, and to reduce repair and maintenance on the pump. A similar type of pump useful for pumping fluids with solid materials is disclosed in U.S. Pat. No. 4,575,308. A significant problem with these latter types of pumps, however, is that the pumps deliver a relatively low pressure head to the fluid, so that the pump with a conventionally sized motor cannot be successfully used to pump fluids over a large distance. The efficiency of the pump under high pressure is so poor that the pump cannot be practically used in many applications where the fluid which contains the solid material must be pumped vertically a distance of 20 feet or more.

The disadvantages of the prior art are overcome by the present invention, and an improved centrifugal pump is hereinafter disclosed which is particularly suitable for pumping liquids containing solid materials which have heretofore caused plugging, jamming, or excessive repair to prior art pumps.

SUMMARY OF THE INVENTION

The centrifugal pump according to the present invention includes a fluid inlet aligned axially with the pump motor, a plurality of backward-inclined impeller blades within the pump housing, and a fluid outlet generally tangential to the pump housing. The pump of the present invention may be reliably used, for example, to pump water mixed with solid particles of varying diameters up to one half inch from a twenty foot deep pit to the surface. Accordingly, the pit may be cleaned by adding water to the debris at the bottom of the pit, and pumping the mixture to the surface. This pump cleaning operation is considerably quicker and less expensive than prior art techniques, wherein laborers with buckets and ropes were used to manually clean the pit.

The pump housing defines a cylindrical-shaped first cavity adjoining the fluid outlet, and an upstream frustoconical second cavity extending between the fluid inlet and the first cavity. Each of the impeller vanes includes a first portion positioned within the first cavity and having an edge uniformly spaced from the pump axis, which edge effectively defines the diameter of the impeller. Each impeller vane also includes a second upstream portion positioning within the second cavity, and which has an angled edge which increases in diameter moving axially from the inlet to the first portion.

The axial length of the second cavity is preferably at least one third the diameter of the first cavity, so that the velocity of the fluid is slowly increased between the pump inlet and the pump outlet, thereby minimizing slippage and increasing efficiency. Solid objects within the fluid, normally being more dense than the fluid, will generally be thrust by centrifugal force toward a gap between the impeller and the housing, thereby minimizing the likelihood that relatively large solid objects will engage the impeller vanes. The gap or clearance between each of the impeller vanes and the interior wall of the pump housing is sizable, typically one quarter inch or more. This gap, which preferably remains constant or increases moving axially away from the pump inlet, thus decreases the likelihood that solid objects will become jammed between the impeller and the pump housing. The impeller vanes are preferably backward-inclined, thereby further minimizing the likelihood of pump jamming or plugging.

It is an object of the present invention to provide an improved centrifugal pump which may be reliably used to transport pressurized liquids containing sizable solid objects.

It is a further object of the present invention to provide a pump which is not susceptible to jamming or plugging, and which may efficiently pump liquids under pressure using a relatively low horsepower motor.

It is a feature of the present invention that the pump include a pump housing with a cylindrical cavity and an upstream frustoconical cavity having an axial length of at least one third the diameter of the cylindrical cavity. The pump includes a plurality of impeller vanes each having first and second portions effectively positioned within the corresponding cavities of the pump housing, and having their edges substantially spaced from the interior walls of the pump housing.

It is a further feature of the present invention that the clearance between the edges of the impeller vanes and the internal walls of the housing remain equal or increase moving axially away from the inlet to the pump.

The pump of the present invention has an advantage in that solid objects within the liquid will move radially outward by centrifugal force toward engagement with the side walls of the pump housing as the objects move axially away from the inlet and toward the outlet. The pump of the present invention is thus able to reliably transport liquids with solid objects with little likelihood of the pump becoming plugged or jammed, and with relatively low maintenance costs for operating the pump.

It is a further advantage of the present invention that the pump may reliably pump fluids containing solid objects, and may transport such fluids under a relatively high pressure head with a relatively low horsepower motor.

These and further objects, features, and advantages of the present invention will become apparent from the following detailed description, wherein reference is made to the figures in the accompanying drawings.

DETAILED DESCRIPTION OF PREFERRED EMBODIMENTS

Figure 1:
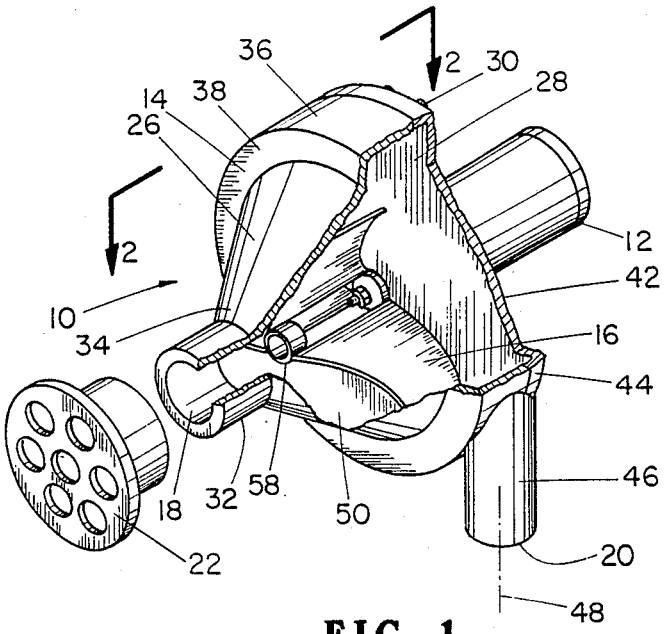
FIG. 1 is a pictorial view, partially in cut away, of a suitable pump according to the present invention.

Referring to FIG. 1, there is depicted a centrifugal pump according to the present invention useful for transporting pressurized liquids containing a relatively large concentration of solid materials carried in suspension therein. The pump of this invention may, for example, be used to pump sludge, waste material, and solids from the bottom of a 20-foot deep machine pit to the surface for disposal. In order to clean the pit, water may be added so that the sludge, mud, and solid debris may mix thoroughly with the added water to form a slurry which may then be transported to the surface by the pump. It should be understood that while the solid suspended particles in the liquid will vary in size, the pump according to the present invention is reliably able to handle solid particles, such as metal chunks, stones, plastic, wood, etc., of one-half inch or more in nominal diameter without plugging or jamming of the pump.

The pump 10 is preferably a submersible pump which may be lowered into the pit and positioned below the water level. Accordingly, a prime mover, such as a submersible hydraulic motor 12, is provided for driving the pump. The pump includes a metal pump housing 14, an impeller 16 rotatable within the housing, a fluid inlet 18, and a fluid outlet 20. Depending on the application which the pump is used, a strainer 22 with a plurality of one-inch through ports may be provided upstream of the pump for mechanically limiting the size of solid particles to the pump to a desired value.

The pump housing includes a unitary front portion 26 and a unitary rear portion 28 removably attached and sealed together in conventional fashion by bolts 30. Front portion 26 includes a small diameter sleeve-shaped member 32 which defines the fluid inlet 18 to the pump, and frustoconical intermediate member 34, a large diameter sleeve-shaped member 36, and a planar intermediate radial wall 38 structurally interconnecting the members 34 and 36. A rear portion 28 of the housing includes a large diameter radial end wall 42 and a stub-like sleeve member 44 at the periphery thereof for alignment and sealing with sleeve portion 36. With the exception of the discharge sleeve member 46 discussed subsequently, the entire front portion 26 and rear portion 28 of the housing are preferably symmetrical about a central pump axis 40. A sleeve member 46 having a discharge axis 48 substantially perpendicular to the central axis 40 provides the fluid outlet 20 from the pump. It should be understood that a rigid or flexible fluid line (not shown) would conventionally be attached to sleeve 46 for passing pressurized fluid from the pump to its desired location.

Figure 2:
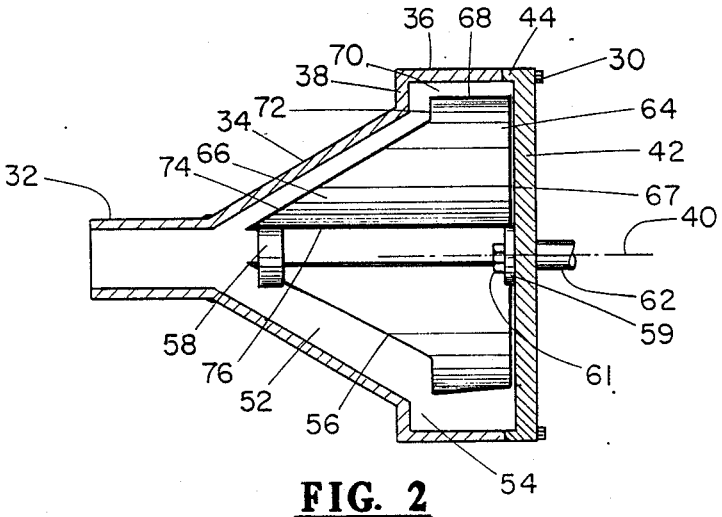
FIG. 2 is a cross-sectional view taken along line 2—2 in FIG. 1.

Pump housing 26 defines an internal cavity 50 for receiving the rotatable impeller 16, and comprises two distinct portions 52 and 54 as shown in FIG. 2. Portion 54 has a generally cylindrical configuration defined by intermediate wall 38, end wall 42, and aligned sleeve members 36 and 44. Cylindrical cavity 54 is thus in fluid communication with outlet 20, and rotation of fluid in cavity 54 imparts the desired "pressure head" to the fluid sufficient to pump the fluid over a desired length of fluid line and/or to pump the fluid vertically a desired distance. The cavity portion 52 is frustoconical in its configuration, having its inlet end equal to the diameter of inlet 18, and its outlet substantially equal in diameter to cylindrical portion 54. The axial length of the frustoconical cavity portion 52 is critical to the pump according to the present invention, and is at least one third and preferably approximately one-half or more the diameter of the cavity portion 54.

Figure 3:
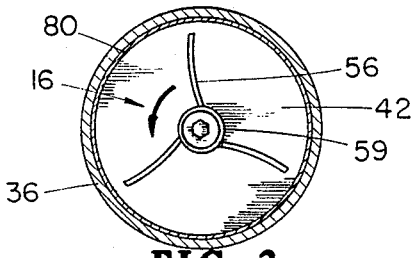
FIG. 3 is a cross-sectional view of another embodiment of a pump according to the present invention, looking toward the end wall of the pump housing and taken along a plane perpendicular to the pump axis and passing through the cylindrical cavity portion of the pump.

Referring briefly to FIG. 3, the impeller 16 includes a plurality, and preferably three or five, backward-inclined blades 56 each uniformly positioned about the axis 40. Accordingly, the direction of rotation for the impeller in FIG. 3 is in the counterclockwise direction, as indicated by the arrow. Each of the blades 56 is weldably secured at its forward end to shaft sleeve 58, and is similarly secured at its rearward end to washer plate 59. Plate 59, in turn, is removably mounted on shaft 62 by bolt 61. Shaft 62 passes through a suitable aperture in wall 42, and is sealed therewith in conventional fashion. Shaft 62, in turn, is preferably coaxial with, or is merely an extension of, the drive shaft of the motor 12.

Referring to FIG. 2, each of the impeller blades 56 comprises a first portion 64 positioned within the first cylindrical-shaped cavity 54, and a second portion 66 in the frustoconical second cavity 52. The rear end 67 of the vane 56 is closely adjacent but out of sealing engagement with the interior surface of wall 42. The outer axial extending edge 68 of portion 64 is spaced uniformly from the central axis 40, so that a gap 70 of a substantially uniform thickness exists between edge 68 and sleeve member 36. The interior surface 72 of portion 64 is parallel to and spaced from the interior wall 38 by a gap of approximately the same spacing, and the inclined edge 74 is similarly parallel to and spaced from housing portion 34 by the gap 70. Thus, the outward axially extending edge 74 of each of the vanes within the frustoconical cavity 52 is spaced from the axis 40 a variable distance directly proportional to its spacing from the fluid inlet 18, and inversely proportional to its axial spacing from the wall 42 and the motor 12.

Each of the vanes 56 is preferably a solid, sheet-like member defined by radially outward edges 68, 72, and 74, radially inward edge 76, and end 67. Within the curved plane of each sheet-like vane, no fluid preferably passes through vane.

It should also be understood that, with reference to chamber portion 52, the term "frustoconical" is intended to refer to a truncated generally conical configuration, although the sidewalls of the "cone" as defined by the interior surface of the housing portion 34 need not be truly conical. While it is important to the present invention that the diameter of the chamber 52 continually increase in direct proportion to its axial spacing from the inlet 18, this increase need not be linear. Thus the interior surface of the housing portion 34, which defines the conical chamber 52, may have a slightly concave configuration (slightly bowl-shaped), or may have a slightly convex configuration (slightly bell-shaped). In any event, however, the cavity 52 is preferably symmetrical about axis 40, and its diameter continually increases moving away from the inlet and toward the outlet. Also, it should be understood that it is preferably that the cavity 52 be "purely conical" to minimize manufacturing costs, so that any interior surface of the pump housing portion 34 cut by any plane including the central pump axis 40 defines a straight line which, with axis 40 as a reference, defines the angle for the increasing volume of the chamber 52. Moreover, in this latter embodiment wherein the chamber 52 is purely conical, edge 74 of each of the vanes 56 lies within a single plane parallel at that position to the adjacent interior surface of the housing portion 34.

The radial spacing between any of the radially outward edges 68, 72, or 74 compared to corresponding interior surface of the housing portions 34, 38, and 36 is substantial, and preferably is at least one-quarter inch or more. The clearance or gap between the radially outward edge and the interior surface of the housing may be uniform as one moves axially in a direction away from the inlet opening 18, or may continually increase as one moves axially away from the opening 18. In any event, however, it is a particular feature of the present invention that this gap or clearance not decrease along any portion of its length as one moves axially away from the inlet 18. Such a decrease in the gap or clearance, even if existing over a relatively short portion, has been found to significantly increase the likelihood that solid particles may become jammed between the edge of the impeller and the housing, thereby jamming the pump and/or damaging the impeller or the housing.

In one embodiment of the present invention, the pump is provided with a two-inch diameter inlet and a two-inch diameter outlet. The 2.5 horsepower hydraulic motor 12 rotates the impeller at a speed of approximately 1500 rpm, and is capable of pumping fluid with solid objects at a volume and pressure head equal to larger sized "mud" pumps powered by a motor two or three times the size of the abovedescribed motor. Accordingly, the relatively small and lightweight unit of the present invention may be reliably used to pump fluids containing a high percentage of solid particles, while prior art larger and more expensive pumps intended for the same purpose frequently plug or require excessive maintenance and repair.

In a typical application, the pump of the present invention may be lowered into a pit containing six to eight inches of a mud/solid particle mixture. Water may be added to the pit to create a more fluid slurry, which is then pumped out of the pit and to the surface by the pump 10. Sizable solid objects having a dimension greater than, for example, one inch may be prefiltered with strainer 22. The mixture which passes through the strainer flows into the pump housing through the inlet 18, and the centrifugal force of the impeller forcefully moves the solid objects, which are generally more dense than the fluid, toward engagement with the housing portion 34. The particulate in the liquid thus tends to "hug" the housing portion 34 rather than occupying the interior of the housing cavity generally along the axis 40. A substantial circumferential spacing is, of course, preferably provided between the edge of one blades and the edge of a subsequent blade, and each of the blades preferably terminates at a location substantially spaced from the interior wall of the housing, thereby creating the above-described one-quarter inch gap. Moreover, the blades are backward-inclined so that the tendency of the blades is to bypass or move along the solid object, rather than allowing the object to become jammed between the end of the blade and the housing.

According to the present invention, the efficiency of the pump is substantially increased since the instantaneous velocity of the solid particles continually increases as the particles move axially in the chamber 52 away from the inlet 18. The mixture is thus not quickly "dumped" into a cylindrical chamber 54, in which case the blades would be required to quickly impart a rotational velocity to the mixture. According to the present invention, slippage is minimized because the tangential velocity of the particles is gradually increased from 0 (or a nominal value) to a high value, thereby creating the desired pressure head.

As one modification of the invention, a relatively thin sheet metal stainless steel liner may be provided within an aluminum pump housing, thereby reducing both weight and manufacturing and repair costs. In this case, the replaceable stainless steel liner may be inserted into the pump housing by removing the end plate 42, and the liner would thus fit securely within and be geometrically similar to the sidewalls 34, 38 and 36 of the depicted pump housing. The liner 80, as shown in FIG. 3, would thus serve as a wear member which could be replaced after a period of use. In this case, the clearance or gap previously described would be between the radially outward edge of the blades and the corresponding interior surface of the liner.

It should be understood that various modifications may be made and will be suggested from the foregoing disclosure. For example, the angled backward-inclined blades and the number of blades may be changed to increase performance. Also, the gap between the radially outward edge of the blades and the adjacent interior surface of the housing may be increased to more than one-quarter inch, and such an increase should allow for the pump to be successfully used to transmit fluids with solid particles of the size greater than was discussed herein. If desired, the shaft sleeve 58 may extend axially through the length of the vanes and may have an end plate at each end so that fluid is prevented from passing along the axis 40 and then between any pair of vanes 56. Each of the components discussed herein may be fabricated from steel and formed by stamping and welding operations. Conventional seals between the components are provided to eliminate leakage from the pump and improve efficiency. The drive means or motor may be of various types, and an explosion-proof motor may be preferred for some applications.

The foregoing disclosure and description of the invention is illustrative and explanatory thereof, and various changes in the size, shape and materials as well as in the details of the illustrated construction may be made within the scope of the appended claims without departing from the spirit of the invention.

What is claimed is:

1. A centrifugal pump suitable for pumping a liquid having solid material carried in suspension therein, the pump including an impeller rotatable about a central pump axis and having a plurality of vanes, powered drive means for rotating the impeller about the central pump axis, and a pump housing defining a fluid inlet positioned along the central axis and a fluid outlet, the pump further comprising:

the pump housing defining a first substantially cylindrical-shaped interior cavity of a fixed diameter and in fluid communication with the fluid outlet;

the pump housing further defining a second frustoconical cavity axially interconnecting the fluid inlet and the first interior cavity, the second cavity having an axial length of at least one-third the fixed diameter of the first cavity;

each of the plurality of vanes having a first portion positioned within the first cavity and having an outward axially extending edge spaced substantially uniformly from the central pump axis:

each of the plurality of vanes further having a second portion within the second cavity and having an outward axially extending edge spaced from the central pump axis a variable distance directly proportional to its spacing from the fluid inlet; and the edge of the first and second portions of each of the plurality of vanes spaced radially a distance from the pump housing, such that a substantial preselected clearance of at least one-quarter inch exists between the radially outward edge of each of the vanes and a corresponding interior surface of the pump housing.

2. A centrifugal pump as defined in claim 1, wherein the preselected clearance between the radially outward edge of the first and second portions of each of the vanes and the interior surface of the pump housing remains substantially constant with increased axial spacing from the pump inlet.

3. A centrifugal pump as defined in claim 1, wherein each of the vanes of the impeller are backward-inclined.

4. A centrifugal pump as defined in claim 1, wherein any interior surface of the pump housing defining the frustoconical cavity and within any plane including the central pump axis lies along a straight line.

5. A centrifugal pump as defined in claim 4, wherein the edge of the second portion of each of the plurality of vanes lies in a plane parallel to the adjacent interior surface of the pump housing defining the second cavity.

6. A centrifugal pump as defined in claim 1, wherein the impeller includes at least three substantially identical vanes.

7. A centrifugal pump as defined in claim 1, wherein the fluid outlet of the pump lies along a discharge axis substantially tangential to the first cylindrical-shaped cavity.

8. A centrifugal pump as defined in claim 1, wherein the pump housing includes a replaceable metallic liner which defines the interior surface of the pump housing.

9. A centrifugal pump as defined in claim 1, wherein:

the powered drive means for rotating the impeller is an hydraulically-powered motor; and the motor has a shift with its axis coaxial with the central pump axis.

10. A centrifugal pump as defined in claim 1, wherein the preselected clearance between the radially outward edge of the first and second portions of each of the vanes and the interior surface of the pump housing continually increases with increased axially spacing from the pump inlet.

11. A centrifugal pump for pumping a liquid having solid material carried in suspension therein, the pump including an impeller rotatable about a central pump axis and having a plurality of vanes, powered drive means for rotating the impeller about the central pump axis, and a pump housing defining a fluid inlet and a fluid outlet, the pump further comprising:

the pump housing defining a first cylindrical-shaped interior cavity of a fixed diameter and in fluid communication with the fluid outlet;

the pump housing further defining a second frustoconical cavity axially interconnecting the fluid inlet and the first interior cavity, the second cavity having an axial length of at least one-third the fixed diameter of the first cavity;

each of the plurality of vanes having a first portion positioned within the first cavity and having an outward axially extending edge spaced substantially uniformly from the central pump axis;

each of the plurality of vanes further having a second portion within the second cavity and having an outward axially extending edge spaced from the central pump axis a variable distance directly proportional to its spacing from the fluid inlet; and the edge of the first and second portions of each of the plurality of vanes spaced a distance from the pump housing to define a preselected clearance of at least one-quarter inch between the radially outward edge of the first and second portion of each of the vanes and a corresponding interior surface of the pump housing.

12. A centrifugal pump as defined in claim 11, wherein each of the vanes of the impeller are backward-inclined.

13. A centrifugal pump as defined in claim 11, wherein each of the vanes is a substantially sheet-like member, and the edge of the second portion of each of the plurality of vanes lies in a plane generally parallel to the adjacent interior surface of the pump housing defining the second cavity.

14. A centrifugal pump comprising:

an impeller rotatable about a central pump axis and having at least one backward-inclined vane;

a pump housing defining (a) a fluid inlet, (b) a fluid outlet, (c) a first substantially cylindrical-shaped interior cavity of a fixed diameter and in fluid communication with the fluid outlet, and (d) a second frustoconical cavity axially interconnecting the fluid inlet and the first interior cavity, the second cavity having an axial length of at least one-third the fixed diameter of the first cavity;

each of the at least one vanes having (a) a first portion positioned within the first cavity and having an outward axially extending edge spaced substantially uniformly from the central pump axis, and (b) a second portion within the second cavity and having an outward axially extending edge spaced from the central pump axis a variable distance directly related to its spacing from the fluid inlet; and the edge of the first and second portions of each of the at least one vanes spaced radially a preselected clearance of at least one-quarter inch from the pump housing, such that each of the at least one vanes remains out of sealing engagement with the pump housing.

15. A centrifugal pump as defined in claim 14, wherein the preselected clearance between the edge of the first and second portions of each of the at least one vanes and the pump housing remains substantially constant with increased axial spacing from the pump inlet.

16. A centrifugal pump as defined in claim 14 wherein any interior surface of the pump housing defining the frustoconical cavity and within any plane including the central pump axis lies along a straight line.

17. A centrifugal pump as defined in claim 18, wherein the edge of the second portion of each of the plurality of vanes lies in a plane generally parallel to the adjacent interior surface of the pump housing defining the second cavity.

18. A centrifugal pump as defined in claim 14, further comprising a hydraulically-powered motor for rotating the impeller a the central pump axis.

19. A centrifugal pump as defined in claim 14, wherein the preselected clearance between the edge of the first and second portions of each of the at least one vanes and the pump housing increases with increased axial spacing from the pump inlet.

* * * * *

UNITED STATES PATENT AND TRADEMARK OFFICE

CERTIFICATE OF CORRECTION

PATENT NO. : 4,932,837

DATED : June 12, 1990

INVENTOR(S) : Ted R. Rymal

It is certified that error appears in the above-identified patent and that said Letters Patent is hereby corrected as shown below:

In Column 10, line 7, delete "claim 18" and insert therefor --claim 16--.

In Column 10, line 15, delete "a" and insert therefor --about--.

Signed and Sealed this

Sixteenth Day of July, 1991

*Attest:*

HARRY F. MANBECK, JR.

*Attesting Officer*

*Commissioner of Patents and Trademarks*